United States Patent [19]

Goloff et al.

[11] 3,989,424

[45] Nov. 2, 1976

[54] ENGINE PORTS

[75] Inventors: Alexander Goloff, East Peoria; Noble G. Barker, Pekin; James A. Ritchie, Peoria Heights, all of Ill.

[73] Assignee: Caterpillar Tractor Co., Peoria, Ill.

[22] Filed: Oct. 31, 1975

[21] Appl. No.: 627,825

[52] U.S. Cl. ..... 418/83; 418/178; 277/22; 123/41.41; 123/41.77; 123/41.85

[51] Int. Cl.[2] ..... F01C 21/06; F04C 29/04; F02F 11/00; F01P 3/14

[58] Field of Search ..... 418/83, 178; 123/8.01, 123/41.41, 41.77, 41.85; 137/340; 277/22, 165

[56] References Cited

UNITED STATES PATENTS

| | | | |
|---|---|---|---|
| 868,978 | 10/1907 | Fischer | 123/41.85 |
| 2,085,810 | 7/1937 | Ljungstrom | 123/41.77 |
| 2,415,774 | 2/1947 | Voorhies | 123/41.85 |
| 3,139,836 | 7/1964 | Jungbluth | 418/83 |

FOREIGN PATENTS OR APPLICATIONS

| | | | |
|---|---|---|---|
| 76,875 | 1/1955 | Netherlands | 123/41.85 |

*Primary Examiner*—John J. Vrablik
*Attorney, Agent, or Firm*—Wegner, Stellman, McCord, Wiles & Wood

[57] ABSTRACT

An improved ported mechanism such as an engine, compressor or the like. The mechanism includes a housing defining a chamber and a liner is disposed within the housing and supported thereby to define the chamber walls. Coolant passages extend between the housing and the liner and a piston is movable within the chamber. A port receiving opening is located in the housing and a port in the liner is provided and includes a tubular element extending from the liner into the opening. A fluid-impervious heat transfer impeding structure is exteriorly of and surrounds the tubular element and is disposed within the opening. A flexible seal is in the opening and interposed between the housing and the heat transfer impeding device so that the seal prevents leakage at the port and the impeding device prevents rapid deterioration of the seal.

7 Claims, 5 Drawing Figures

ENGINE PORTS

BACKGROUND OF THE INVENTION

This invention relates to ported mechanisms, such as engines, compressors, pumps, or the like, whether of the rotary or of the reciprocating variety. More specifically, the invention relates to improved ports in such mechanisms.

Increasingly, in ported mechanisms, liners are employed to serve as replaceable wearing elements of the housings of such mechanisms. Frequently, it is desirable that such liners be cooled directly by the coolant. That is, the coolant is frequently brought into direct contact with the liner in passages located between the liner and the housing.

As a consequence, leakage at the ports has posed a particular difficulty. Gases, especially exhaust gases when the mechanism is an engine, may enter the coolant. Alternately, the coolant may flood the internal chamber of the mechanism.

In using such liners, to prevent distortion of wearing surfaces, it is necessary to provide for small relative movement between the ports integral with the liner and the housing. Without the provision for such movement, distortion will occur at the rubbing surfaces.

A seal is employed to seal the port elements and the housing and such seals typically must allow for the previously mentioned movement. Seals usually employed for the purpose frequently have a relatively short life, particularly when employed in connection with exhaust ports of internal combustion engines, because of high operating temperatures.

SUMMARY OF THE INVENTION

It is the principal object of the invention to provide a new and improved ported mechanism. More specifically, it is an object of the invention to provide a new and improved port construction for such mechanisms including improved seals between housing and liner in the vicinity of the ports.

An exemplary embodiment of the invention achieves the foregoing object in a structure including a housing defining a chamber. A liner is within the housing and is supported thereby to define chamber walls. Coolant passages extend between the housing and the liner and a piston is movable within the chamber. A port receiving opening is disposed in the housing and the port in the liner includes a tubular element extending from the liner into the opening. Fluid-impervious heat transfer impeding means are located exteriorly of and surround the tubular element within the opening. A flexible seal is located in the opening and is interposed between the housing and the heat transfer impeding means. As a result, the seal prevents leakage at the port and the heat transfer impeding means prevents rapid deterioration of the seal.

The invention is applicable to a variety of types of ported mechanisms such as rotary or reciprocating mechanisms used as engines, pumps, compressors, or the like.

In a preferred embodiment of the invention, a seal receiving groove is disposed on either the heat transfer impeding means or the housing within the opening. The seal is received within the groove.

According to one embodiment of the invention, the heat transfer impeding means comprises a sleeve joined at one end to the tubular element and has portions spaced from the tubular element. The portions define an insulating space.

According to another embodiment of the invention, the impeding means comprise a generally radially outwardly extending web on the tubular element with part of the web fronting on the coolant passage to be cooled thereby.

In one embodiment, the web terminates in a cylindrical section and the seal is carried in a groove in the cylindrical section. According to another embodiment, the web also terminates in a cylindrical section, but a seal receiving groove is disposed within the housing opening. The seal sealingly engages the cylindrical section.

Other objects and advantages will become apparent from the following specification taken in connection with the accompanying drawings.

DESCRIPTION OF THE PREFERRED EMBODIMENTS

Figure 1:
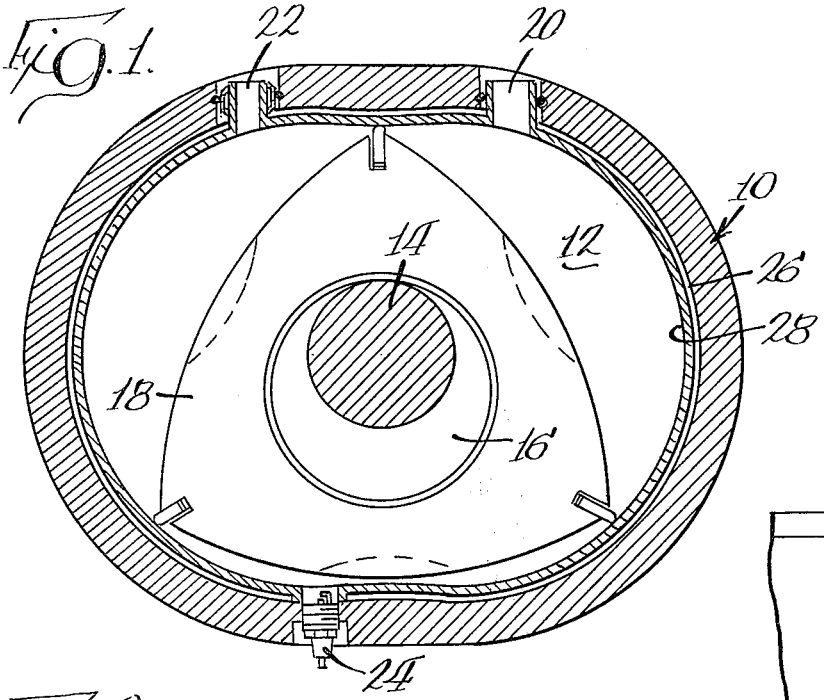
FIG. 1 is a sectional view of a ported mechanism embodying the invention, specifically, a trochoidal internal combustion engine.

An exemplary embodiment of a ported mechanism made according to the invention is illustrated in FIG. 1 in the form of a trochoidal engine. However, it is to be understood that the invention finds applicability in mechanisms other than engines, such as pumps or compressors, and is not restricted to rotary mechanisms. For example, the same may be advantageously employed in reciprocating mechanisms, as will more fully hereinafter appear.

The mechanism includes a housing, generally designated 10, frequently formed of cast iron or the like, defining a chamber 12. A shaft 14 having an eccentric 16 within the chamber 12 is journalled in the housing 10 and mounts a rotary piston 18 therein in a conventional manner.

The housing 10 is provided with an intake port 20 and an exhaust port 22 at approximately the positions illustrated. In addition, a spark ignition device 24 is provided.

Circumferentially extending ribs 26 are formed in the housing 10 and face the chamber 12. The ribs 26 support an interior liner 28 against collapse during operation of the mechanism. The space between the ribs 26 serves as coolant passages for a coolant such as water to be circulated about and in intimate contact with the liner 28 for the usual cooling purposes. As is well known, the liner 28, once its useful life has been exceeded, can be replaced without replacing the housing 10, the shaft 14 or the rotary piston 18.

Figure 2:
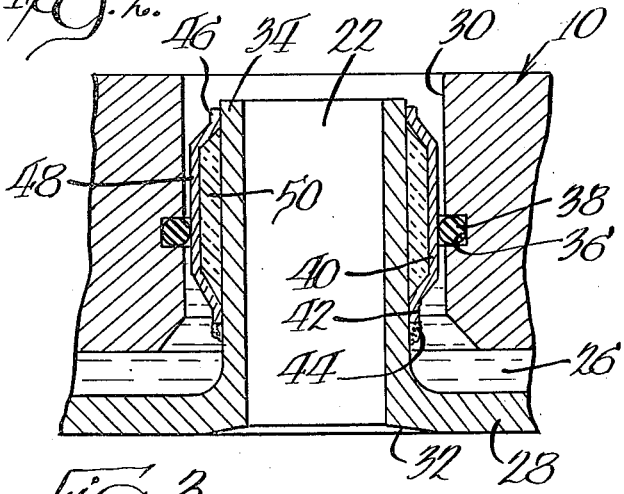
FIG. 2 is an enlarged, fragmentary sectional view of one embodiment of a port made according to the invention.

With reference now to FIG. 2, the exhaust port 22 will be described in greater detail. The housing 10 includes a port receiving opening 30. The liner 28 is provided with a port-like opening 32 and a tube 34 extending into the opening 30. An inwardly opening groove 36 is formed in the opening 30 and receives a conventional flexible O-ring 38 which may be formed of any suitable elastomer.

A sleeve 40 has a crimped end 42 welded as at 44 to the tube 34. The opposite end 46 of the sleeve 40 is free to slide on the tube 34. The intermediate portion 48 of the sleeve is spaced from the tube 34 to define an insulating area 50 which may be filled with any suitable insulating material.

The O-ring sealingly engages the intermediate portion 48 of the sleeve 34. By reason of the weld 44, the sleeve 40 serves as a liquid-impervious heat transfer impeding means retarding the transfer of heat from hot exhaust gases passing through the port 22 to the O-ring 38. Thus, the O-ring 38 provides adequate sealing, preventing coolant from entering the engine cavity or exhaust gases from mixing with the coolant while the heat transfer impeding means prevent early destruction of the O-ring 38 due to high temperatures.

It will also be appreciated that differential expansion of the parts can be accommodated without causing a distortion of the liner 28 by reason of the fact that the seal is maintained even though there may be relative movement between the tube 34 and the housing 10. Moreover, a manifold or the like may be secured to the housing 10 without affecting the geometry of the various parts to cause undesirable distortion of the rubbing surfaces.

Figure 3:
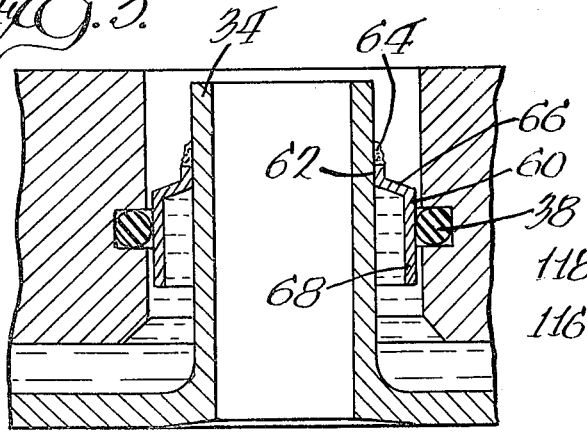
FIG. 3 is an enlarged, fragmentary sectional view of another embodiment of a port made according to the invention.

FIG. 3 illustrates a further embodiment of the invention. In lieu of the sleeve 40, a sleeve 60 is employed. The sleeve 60 has an end 62 secured as by welding 64 to the tube 34. A radially outwardly extending web 66 extends from the end 62 and terminates in a cylindrical section 68 which is sealingly engaged by the O-ring 38. As can be seen, the coolant contacts one side of the web 66 as well as the inner surface of the cylindrical section 68 to cool the same, thereby maintaining the O-ring 38 at a low temperature. The web 66 serves as a heat transfer impeding means in that it lengthens the path that heat energy must travel to the seal 38 over the length of the path if the seal 38 were to directly contact the exterior of the tube 34 and in that it is cooled by the coolant.

Figure 4:
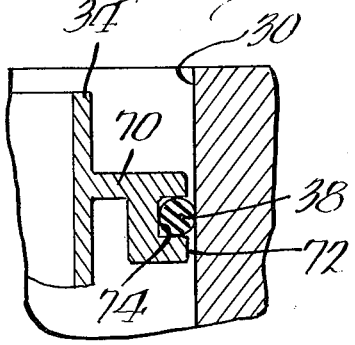
FIG. 4 is an enlarged, fragmentary sectional view of still another embodiment.

Still a further embodiment is illustrated in FIG. 4. The tube 34′ is provided with an integral, radially outwardly extending web 70 terminating in a cylindrical section 72. The cylindrical section 72 is provided with an outwardly opening groove 74 for receipt of the seal 38. The seal 38 sealingly engages the side of the opening 30. Again, the web 70 serves as a heat transfer impeding means for the same reasons as the web 66.

Figure 5:
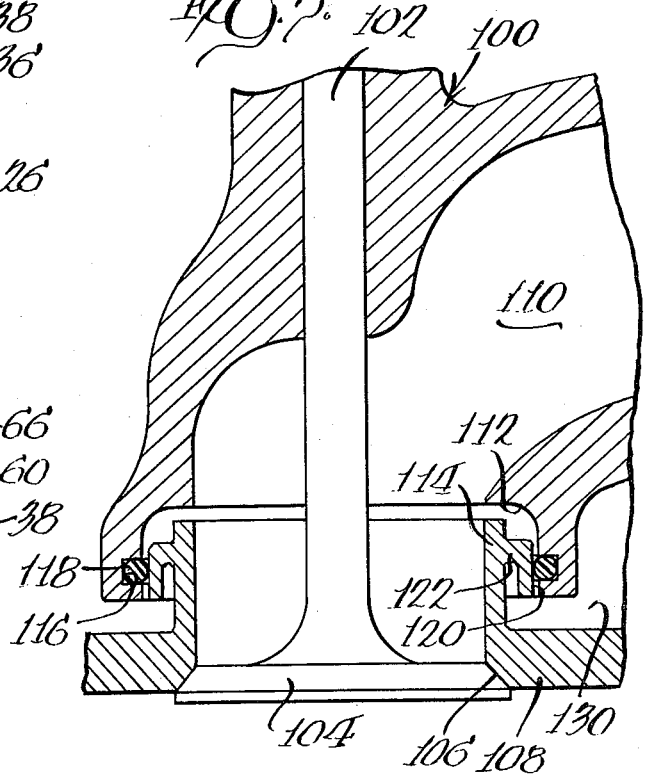
FIG. 5 is a fragmentary, enlarged sectional view of still another embodiment of the invention as applied to a reciprocating engine having valves.

FIG. 5 illustrates still another embodiment of the invention wherein the same may be employed in a valve mechanism such as a reciprocating engine. Specifically, a housing 100 slidably mounts the stem 102 of a valve 104 for selective movement of the valve 104 between positions opening and closing a port 106 formed in a liner 108 for the head of a cylinder or the like. The housing 100 is provided with a conduit 110 which may be in fluid communication with an exhaust manifold or the like. The conduit 110 includes an enlarged opening 112 which receives a tube 114 extending from the liner 108 about the port 106. The opening 112 is provided with an inwardly opening groove 116 for receipt of an O-ring 118 which sealingly engages a cylindrical section 120 disposed on the radially outer extremity of a radially outwardly extending web 122 integral with the tube 114. An area 130 between the housing 100 and the liner 108 receives coolant in a conventional fashion.

It will be appreciated that the web 122 serves as a heat transfer impeding means in the same fashion as the webs 66 and 70.

From the foregoing, it will be appreciated that a port construction made according to the invention eliminates leakage difficulties in lined, ported mechanisms and yet provides a long-lived seal permitting differential expansion or contraction of the parts without causing distortion of rubbing surfaces.

What is claimed is:

1. A ported mechanism comprising:
a housing defining a chamber;
a piston movable within said chamber;
a port receiving opening in said housing;
a liner within said housing and defining chamber walls;
a port within said liner and including a tubular element received within, but spaced from, said opening;
a generally cylindrical element surrounding, in spaced relation, said tubular element and within said opening;
means defining a web sealingly engaging and extending from said tubular element to said cylindrical element for supporting said cylindrical element in said spaced relation such that a portion thereof is axially spaced from said web;
coolant passages between said housing and said liner and said opening, said web and said cylindrical element; and
a seal interposed between and sealingly engaging said portion of said cylindrical element and said housing at said opening;
whereby said seal prevents leakage at said port while said passages and said cylindrical element prevent rapid thermal deterioration of said seal.

2. The mechanism of claim 1 further including a valve slidably mounted on said housing and extending through said tubular element for selectively opening and closing said port.

3. The ported mechanism of claim 1 wherein said portion is directed toward said chamber from said web.

4. The ported mechanism of claim 3 wherein said housing opening includes a radially inwardly opening annular groove, said seal being disposed in said groove.

5. The ported mechanism of claim 3 wherein said cylindrical element portion includes a radially outwardly opening groove, said seal being disposed in said groove.

6. A ported mechanism comprising:
a housing defining a chamber;
a piston movable within said chamber;
a port receiving opening in said housing;
a liner within said housing and defining chamber walls;
a port within said liner and including a tubular element received within, but spaced from, said opening;
a sleeve surrounding said tubular element and within said opening, said sleeve having its ends abutting said tubular element and a portion intermediate said ends spaced from said tubular element to define an insulating space;

coolant passages between said housing and said liner and said opening and part of said sleeve including an end thereof;

the end of said sleeve adjacent said coolant passages being sealingly secured to said tubular element; and a seal interposed between and sealingly engaging said portion of said sleeve and said housing at said opening;

whereby said seal prevents leakage at said port and said insulating space prevents rapid thermal deterioration of said seal.

7. The ported mechanism of claim 6 wherein said housing opening includes a radially inwardly opening annular groove, said seal being disposed in said groove.

* * * * *